United States Patent [19]

Fujishiro

[11] 4,163,433

[45] Aug. 7, 1979

[54] AIR/FUEL RATIO CONTROL SYSTEM FOR INTERNAL COMBUSTION ENGINE HAVING COMPENSATION MEANS FOR VARIATION IN OUTPUT CHARACTERISTIC OF EXHAUST SENSOR

[75] Inventor: Takeshi Fujishiro, Yokohama, Japan

[73] Assignee: Nissan Motor Company, Limited, Japan

[21] Appl. No.: 753,177

[22] Filed: Dec. 22, 1976

[30] Foreign Application Priority Data

Dec. 27, 1975 [JP] Japan ..... 50/155771

[51] Int. Cl.[2] ..... F02B 3/00

[52] U.S. Cl. ..... 123/119 EC; 123/32 EE

[58] Field of Search ..... 123/32 EE, 32 EA, 119 R, 123/119 EC, 140 MC; 60/276, 285

[56] References Cited

U.S. PATENT DOCUMENTS

| | | | |
|---|---|---|---|
| 3,782,347 | 1/1974 | Schmidt et al. | 123/140 MC |
| 3,874,171 | 4/1975 | Schmidt et al. | 123/32 EE |
| 4,029,061 | 6/1977 | Asano | 123/32 EE |

FOREIGN PATENT DOCUMENTS

| | | |
|---|---|---|
| 2336558 | 3/1974 | Fed. Rep. of Germany . |
| 2333743 | 1/1975 | Fed. Rep. of Germany . |
| 2622049 | 2/1976 | Fed. Rep. of Germany . |
| 2547112 | 4/1976 | Fed. Rep. of Germany . |

*Primary Examiner*—Charles T. Jordan

*Attorney, Agent, or Firm*—Lane, Aitken & Ziems

[57] ABSTRACT

In a feedback control system for maintaining the air/fuel ratio of a combustible mixture fed to an internal combustion engine at a preset ratio based on the output of an exhaust sensor, a control signal producing circuit having a proportional amplifier and/or an integrator is constructed so as to vary the proportionality constant or the time constant for the integration in dependence on the temperature and flow velocity of the exhaust gas, with a purpose of avoiding an error in the control attributable to a variation in the output characteristic of the exhaust sensor with variations in the condition of the exhaust gas by superficially shifting the aim of the control from the preset ratio to a provisional ratio.

10 Claims, 9 Drawing Figures

AIR/FUEL RATIO CONTROL SYSTEM FOR INTERNAL COMBUSTION ENGINE HAVING COMPENSATION MEANS FOR VARIATION IN OUTPUT CHARACTERISTIC OF EXHAUST SENSOR

This invention relates to a feedback control system for maintaining the air-to-fuel ratio of a combustible mixture fed to an internal combustion engine at a preset ratio, which system is of the type having an exhaust sensor for estimating a realized air-to-fuel ratio and a control circuit for providing a control signal based on a deviation of the output of the exhaust sensor from a reference signal, and more particularly to an improvement in the control circuit for allowing the circuit to produce the control signal in a variable relationship to the deviation according to the operational condition of the engine as a compensation measure for a variation in the output characteristic of the exhaust sensor with variations in the temperature and flow velocity of the exhaust gas.

In the field of the prevention of air pollution attributable to exhaust gas of internal combustion engines, particularly, for automotive use, it is recognized as important to maintain the air-to-fuel ratio of a combustible mixture fed to the engines exactly at a ratio optimumly preset for each type of engine. A feedback control system as one of hitherto proposed techniques employs an exhaust sensor for developing a feedback signal representing the concentration of a certain component (which may be $O_2$, CO, $CO_2$, HC or $NO_x$) of the engine exhaust gas as an indication of an air-to-fuel ratio realized in the engine. The outline of this control system and a problem encountered by the system will be described below with reference to part of the accompanying drawings.

Figure 1:
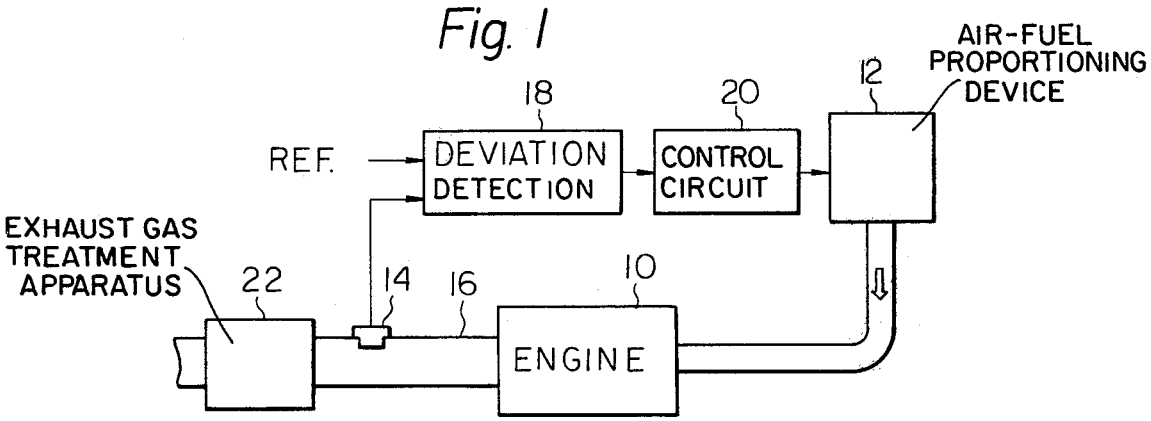
FIG. 1 is a block diagram of an air-to-fuel ratio control system in an internal combustion engine.

Referring to FIG. 1, an internal combustion engine 10 is operated by an electrically controllable air-fuel proportioning device 12 such as a carburetor or a fuel injection system. An exhaust sensor 14 is installed in an exhaust line 16 of the engine 10. The illustrated feedback control system has a deviation detection circuit 18 which may essentially be a differential amplifier or a comparator and provides an output representing the magnitude of a deviation of the output voltage of the exhaust sensor 14, from a reference voltage corresponding to an optimumly preset air-to-fuel ratio. A control circuit 20 produces a control signal for controlling the operation of the air-fuel proportioning device 12 based on the output of the deviation detection circuit 18. The control circuit 20 has either a proportional amplifier for proportionating the control signal to the deviation or an integrator for producing the control signal by integrating the deviation. Alternatively, the control circuit 20 comprises a proportional amplifier, an integrator and an adder such that the control signal represents the addition of a component proportional to the deviation to another component obtained by an integration of the deviation. In response to the control signal, the fuel feed rate and/or the air feed rate in the air-fuel proportioning device 12 is minutely regulated, additionally to a usual regulation according to variations in principal factors in the engine operation typified by the degree of opening of the throttle valve, in order to maintain the air-to-fuel ratio at the preset ratio. The value of the preset ratio is determined so that an exhaust gas treatment apparatus 22 such as a thermal reactor or a catalytic converter included in the exhaust line 16 downstream of the exhaust sensor 14 may work at best efficiency. For example, the preset ratio is at or in the vicinity of a stoichiometric air-to-fuel ratio when the apparatus 22 contains therein a "three-way catalyst" which can catalyze both the reduction of nitrogen oxides and the oxidation of carbon monoxide and hydrocarbons contained in the exhaust gas.

At present, the most familiar example of the exhaust sensor 14 is an oxygen sensor which operates on the principle of a concentration cell and has as its essential element a layer of an oxygen ion conductive solid electrolyte such as, for example, zirconia stabilized with calcia. As is known, the output voltage of this type of oxygen sensor upon exposure to the exhaust gas of the engine 10 is not proportional to an air-to-fuel ratio realized in the engine 10 but stands at one of two distinctly different levels depending on the direction of the deviation of the realized air-to-fuel ratio from the stoichiometric ratio. The output voltage stands at a relatively low level so long as the realized air-to-fuel ratio is above the stoichiometric ratio but stands at a distinctly higher level while the air-to-fuel ratio is below the stoichiometric ratio. If the air-to-fuel ratio varies across the stoichiometric ratio, the output voltage exhibits an abrupt transition from one of the these two levels to the other. Accordingly this type of oxygen sensor is advantageous as the exhaust sensor 14 in FIG. 1 when the control system aims at maintaining the air-to-fuel ratio at or in the vicinity of the stoichiometric ratio.

In practical operation of the control system of FIG. 1, there is a problem that the output characteristic of the exhaust sensor 14 is liable to vary as the operational condition of the engine 10 and, accordingly, the temperature and flow velocity of the exhaust gas vary, resulting in that the air-fuel proportioning device 12 is controlled to establish an air-to-fuel ratio deviating from the preset ratio.

Figure 2:
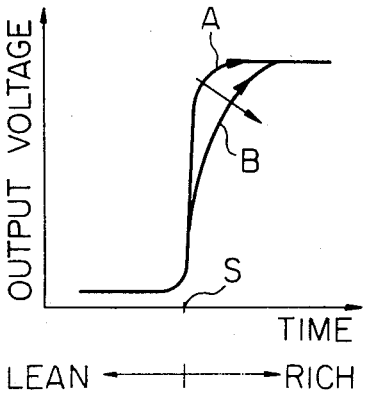
FIGS. 2–4 are graphs showing variations in the output characteristic of a conventional oxygen sensor for use in the control system of FIG. 1 with variations in the temperature and flow velocity of an engine exhaust gas to which the sensor is exposed.
Figure 3:
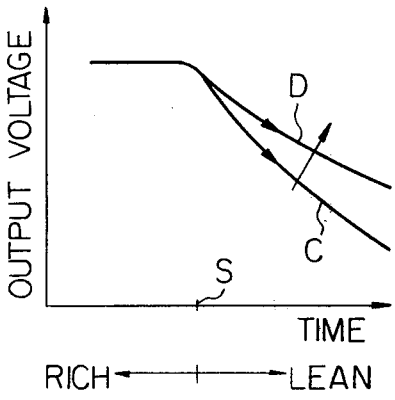

For example, the above described transition of the output voltage of the oxygen sensor from the lower level to the higher level occurs as represented by the curve A in FIG. 2, wherein the point S on the abscissa indicates a moment at which a transition of the air-to-fuel ratio across the stoichiometric ratio from a higher side (lean mixture) to a lower side (rich mixture) occurs, when the exhaust gas has a sufficiently high temperature and flows in the exhaust line 16 at a relatively high velocity. As the temperature and flow velocity of exhaust gas lower, the transition of the output voltage at the point S occurs less abruptly or sharply as indicated by the arrow and represented by the curve B. When the air-to-fuel ratio varies across the stoichiometric ratio from a lower side to the higher side, an actual transition of the output voltage of the oxygen sensor from the higher level to the lower level occurs more slowly or gradually, as represented by the curve C in FIG. 3, than the transition represented by the curve A of FIG. 2.

As the temperature and flow velocity lower, the slowness in the transistion of the output voltage, i.e., a delay in the response of the oxygen sensor to the transition of the air-to-fuel ratio, is further enhanced as represented by the curve D.

Figure 4:
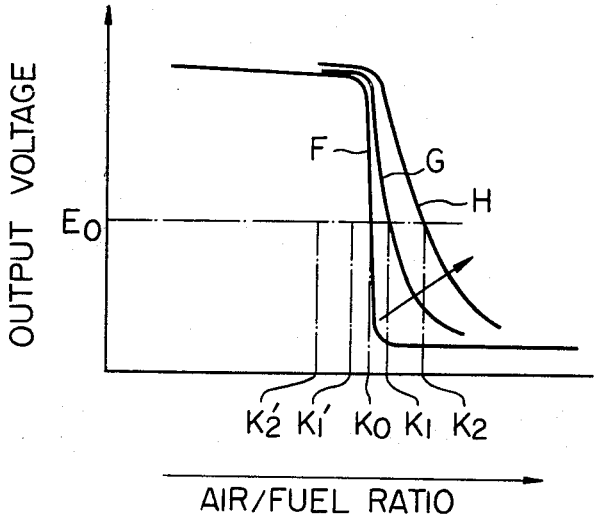

Referring to FIG. 4, an ideal or static output characteristic of the oxygen sensor (the relationship between the output voltage and the air-to-fuel ratio) is as represented by the curve F. When the control system of FIG. 1 is constructed in a conventional manner to maintain the air-to-fuel ratio at $k_0$, the reference voltage to be applied to the deviation detection circuit 18 is constantly settled at $E_o$ based on the curve F. However, an actual or dynamic output characteristic of the oxygen sensor becomes as represented by the curve G or the curve H as the temperature and flow velocity of the exhaust gas lower. As a result, the air-to-fuel ratio is not regulated to the intended ratio $k_0$ but to a higher ratio $k_1$ or $k_2$.

It is an object of the present invention to provide an improved air-to-fuel ratio control system of fundamentally the described type, which system produces a control signal in a variable relationship to a deviation of the output of the exhaust sensor from the reference signal according to the temperature and flow velocity of the exhaust gas such that the above described variation in the output characteristic of the exhaust sensor can be compensated for.

An air-to-fuel ratio control system according to the invention has an electrically controllable air-fuel proportioning device, an exhaust sensor, a deviation detection circuit and a control signal combined in the above described manner and is characterized in that the control circuit comprises a compensation means for superficially shifting the aim of the air-to-fuel ratio control implied by the control signal from the preset ratio to a provisional ratio in dependence on the temperature and flow velocity of the exhaust gas at a section of the exhaust line where the exhaust sensor is disposed. The superficial shift of the aim of the control is performed so as to compensate for a variation in the output characteristic of the exhaust sensor with variations in the temperature and flow velocity of the exhaust gas and avoid a deviation of a realized air-to-fuel ratio from the preset ratio.

It is convenient to utilize a variable factor in the operation of the engine such as, for example, the engine speed, flow rate of air in the intake line or a vehicle speed as an indication of the temperature and flow velocity of the exhaust gas. Still alternatively, the frequency of a variation in the control signal may be utilized for the same purpose.

The control circuit has an integrator and/or a proportionater for composing the control signal as in the above described conventional control circuit. The superficial shift of the aim of the control according to the invention can be accomplished by any one of the following methods.

(1) When the control circuit has an integrator, the superficial shift can be accomplished by providing a difference between a time constant for the integration of a high level input to the integrator (output of the deviation detection circuit) and a time constant for the integration of a low level input to the same integrator. In addition, these time constants may be varied in dependence on, for example, the engine speed. The integrator preferably has an operational amplifier provided with a capacitor to achieve negative feedback therethrough. Then the time constants can be varied by the provision of at least two parallel resistors between the deviation detection circuit and the operational amplifier and at least one diode for selectively making the resistors effective according to the level of the input to the integrator.

(2) When the control circuit has a proportionater, the superficial shift can be accomplished by the employment of two different proportionality constants respectively for amplifying a high level input and a low level input. The difference between the two proportionality constants may be made variable depending on, for example, the engine speed. In this case, the control circuit preferably has a first proportionator which constantly functions as one in the conventional control circuit and a second proportionator which operates on only one of the high-level and low-level inputs. The second proportionater is embodied by a combination of an operational amplifier and a diode.

(3) The superficial shift can also be accomplished by providing a time delay to one of the high-level and low-level inputs to the control circuit.

The provisional air-to-fuel ratio may continuously be varied depending on, for example, the engine speed. Alternatively, the superficial shift of the aim of the control may be accomplished only when the engine speed or exhaust temperature is in a low range, so that the aim of the control shifts to a provisional ratio, which is either constant or variable, in the low exhaust temperature range but remains at the preset air-to-fuel ratio at higher exhaust temperatures.

In the case of the exhaust sensor being an oxygen sensor of the hereinbefore described nature, the air-to-fuel ratio is controlled by the conventional control system to ratios higher than the preset ratio at relatively low exhaust temperatures. In this case, therefore, the control circuit is constructed according to the invention such that the aim of the control is superficially shifted from the preset air-to-fuel ratio to a provisional air-to-fuel ratio which is below the preset ratio and preferably variable at low exhaust temperatures. When the output characteristic of the oxygen sensor is given by the curve G of FIG. 4, the air-to-fuel ratio can be maintained at the preset ratio $k_0$ by superficially shifting the aim of the control from $k_0$ to a lower ratio $k'_1$ the difference of which from $k_0$ is given by $|k_1-k_0|=|k'_1-k_0|$. In the case of the sensor output characteristic being given by the curve H, the same can be accomplished by varying the provisional air-to-fuel ratio to a still lower ratio $k'_2$ defined by $|k_2-k_0|=|k'_2-k_0|$.

The invention will fully be understood from the following detailed description of preferred embodiments.

Figure 5:
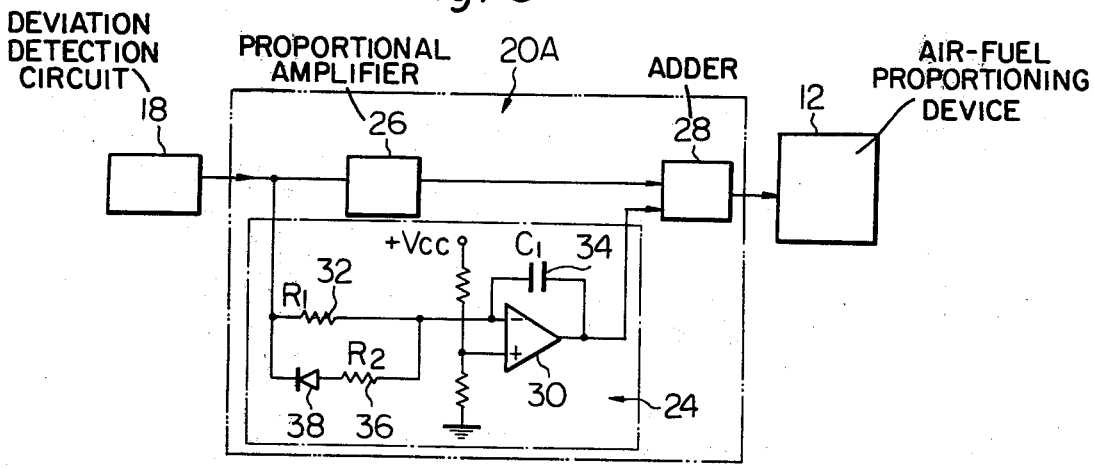
FIG. 5 is a circuit diagram, partly in block form, of a control circuit in the system of FIG. 1 as an embodiment of the invention.

In FIG. 5, a control circuit 20A according to the invention, as the circuit 20 in the control system of FIG. 1, is constructed to provide a variable time constant for an integration of the deviation signal supplied from the deviation detection circuit 18 depending on the plus and minus signs of the deviation thereby to accomplish a continuous shift of the provisional air-to-fuel ratio with a variation in the engine speed as an indication of the exhaust gas temperature and flow velocity. This control circuit 20A includes an integrator 24 according to the invention, a conventional amplifier or proportionator 26 which produces a signal proportional to the output of the deviation detection circuit 18 as a proportional component of the control signal, and a conventional adder 28 for composing the control signal by adding the output of the integrator 24 to that of the proportionator 26. The integrator 24 has an operational amplifier 30, and the output of the deviation detection circuit 18 is applied to the negative input terminal of this operational amplifier 30 through a first resistor 32 having a resistance $R_1$. Negative feedback is afforded to the operational amplifier 30 through a capacitor 34 having a capacitance $C_1$. A second resistor 36 having a resistance $R_2$ is connected in parallel with the first resistor 32, and a diode 38 is connected to govern a current flow through the second resistor 36.

Figure 6:
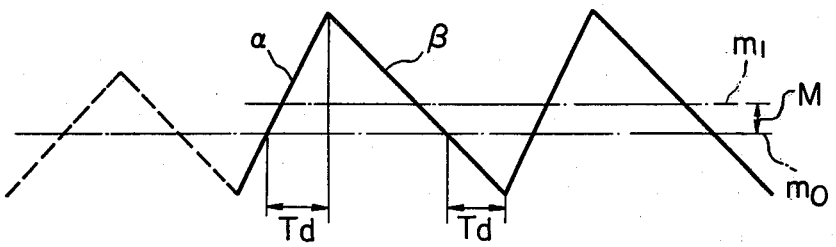
FIG. 6 is a chart showing the waveform of a control signal produced by the control circuit of FIG. 5.

The output of the deviation detection circuit 18 (input to the integrator 24), i.e., the deviation of the output of the oxygen sensor from the reference voltage, becomes alternately plus and minus. The diode 38 is conductive when, for example, the input is a minus signal but non-conductive when the input is plus. The time constant for the integration by the operational amplifier 30 provided with the capacitor 34 is determined by the capacitance $C_1$ and the resistances $R_1$ and $R_2$ while the diode 38 is conductive but by the capacitance $C_1$ and the resistance $R_1$ while the diode 38 is non-conductive. The output of the integrator 24 takes a form as shown by the solid line in FIG. 6. A comparator is used as the deviation detection circuit 18. If the time constant for the integration is constant as in conventional control circuits, the amplitude of the output alternately increases and decreases with the same gradient as the sign of the input alternately becomes minus and plus as shown by the broken line in FIG. 6. The amplitude of this signal is averaged to a value indicated at $m_0$ which corresponds to the preset air-to-fuel ratio $k_0$ (the proportional component of the control signal is left out of consideration here for convenience in explanation). For the integrator 24 of FIG. 5, the output increases with a gradient of $\alpha$ while the input is minus but decreases with a smaller gradient $\beta$ while the input is plus. Consequently, the average amplitude of the control signal shifts from $m_0$ to a higher value $m_1$ which corresponds, for example, to the provisional air-to-fuel ratio $k'_1$ in FIG. 4. If the output characteristic of the exhaust sensor 14 is as represented by the curve G in FIG. 4 in this instance, the air-to-fuel ratio can actually be controlled to the preset ratio $k_0$.

The occurrence of a variation in the actual air-to-fuel ratio in the air-fuel proportioning device 12 is detected by the exhaust sensor 14 with a time delay Td, and the amount of the time delay Td increases as the engine speed lowers. The difference M between the increased average amplitude $m_1$ of the control signal (the average amplitude will hereinafter be referred to as control middle) and the basic control middle $m_0$ is given by the following equation:

$$M=(\alpha-\beta)/2Td$$

Accordingly, the difference M, i.e., the magnitude of the shift of the control middle, continuously increases as the engine speed lowers at a rate determined by the proportion of the resistance $R_2$ to the resistance $R_1$. This means a continuous variation in the provisional air-to-fuel ratio with lowering of the exhaust temperature and flow velocity. Consequently, the actual air-to-fuel ratio can be maintained at the preset ratio even though a noticeable variation occurs in the output characteristic of the exhaust sensor 14 at low exhaust temperatures.

Figure 7:
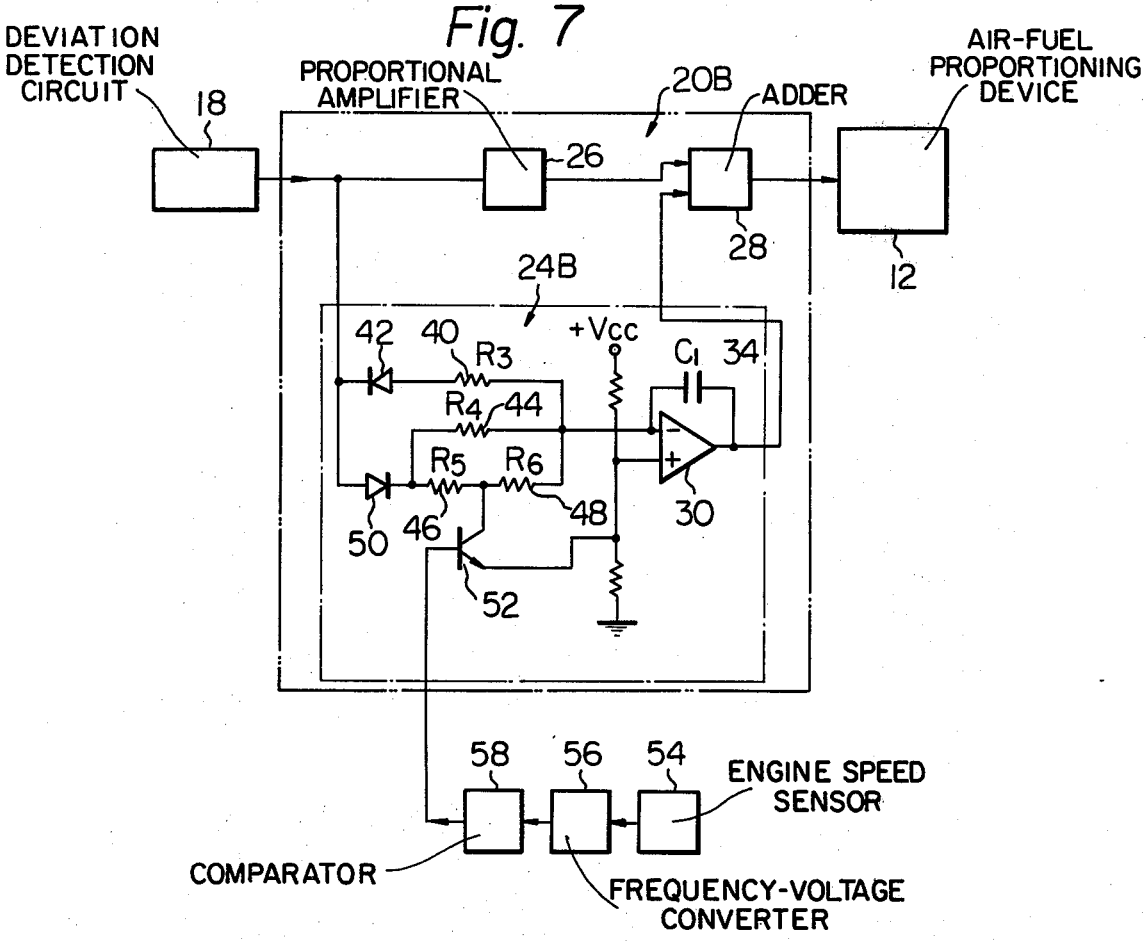
FIG. 7 is a circuit diagram, partly in block form, of a differently constructed control circuit as another embodiment of the invention.

A control circuit 20B shown in FIG. 7 includes an integrator 24B which is constructed to accomplish a shift of the control middle substantially only at engine speeds below a predetermined speed. This integrator 24B has also the operational amplifier 30 provided with the capacitor 34 of the capacitance $C_1$. The input line to the negative input terminal of the operational amplifier 30 consists of three parallel paths: first path having a resistor 40 of a resistance $R_3$ and a diode 42 which is conductive when the input (output of the deviation detection circuit 18) is minus, second path having a resistor 44 of a resistance $R_4$, and third path having two series connected resistors 46 and 48 respectively of the resistances $R_5$ and $R_6$. Another diode 50 is connected inversely and parallel to the diode 42 and in series with both the second and third paths. The integrator 24B has a transistor 52 with its collector connected to the junction between the two series connected resistors 46 and 48 while the emitter is grounded. An engine speed sensor 54 which provides a pulse signal the frequency of which indicates the engine speed. A frequency-voltage converter 56 receives the pulse signal from the sensor 54 and supplies a voltage signal to a comparator 58. This comparator 58 produces an output voltage only when the level of the received voltage signal is below a predetermined level. The output of the comparator 58 is applied to the base of the transistor 52, so that the transistor 52 becomes conductive only when the engine speed is below a predetermined speed.

In the thus constructed integrator 24B, the time constant for the integration of a minus input is determined by the capacitance $C_1$ and the resistance $R_3$. While the transistor 52 is non-conductive at high engine speeds, the time constant for the integration of a plus input is determined by the capacitance $C_1$ and the three resistances $R_4$, $R_5$ and $R_6$. These three resistances $R_4$, $R_5$ and $R_6$ are determined so as to satisfy the following equation:

$$R_4(R_5+R_6)/(R_4+R_5+R_6)\approx R_3$$

Then the integration of the plus input is accomplished on approximately the same time constant as the time constant for the integration of the minus input, so that substantially no shift of the control middle occurs. Accordingly, the preset air-to-fuel ratio is kept nearly constant. When the transistor 52 is conductive, the time constant for the integration of the plus input is determined by the capacitance $C_1$ and the resistance $R_4$. By making the resistance $R_4$ greater than the resistance $R_3$, the output of the integrator 24B at engine speeds below the predetermined speed exhibits an ascent gradient larger than a descent gradient as in the case of the integrator 24 in FIG. 5, resulting in the shift of the aim of the control from the preset air-to-fuel ratio to a provisional ratio which varies with a lowering of the engine speed.

Figure 8:
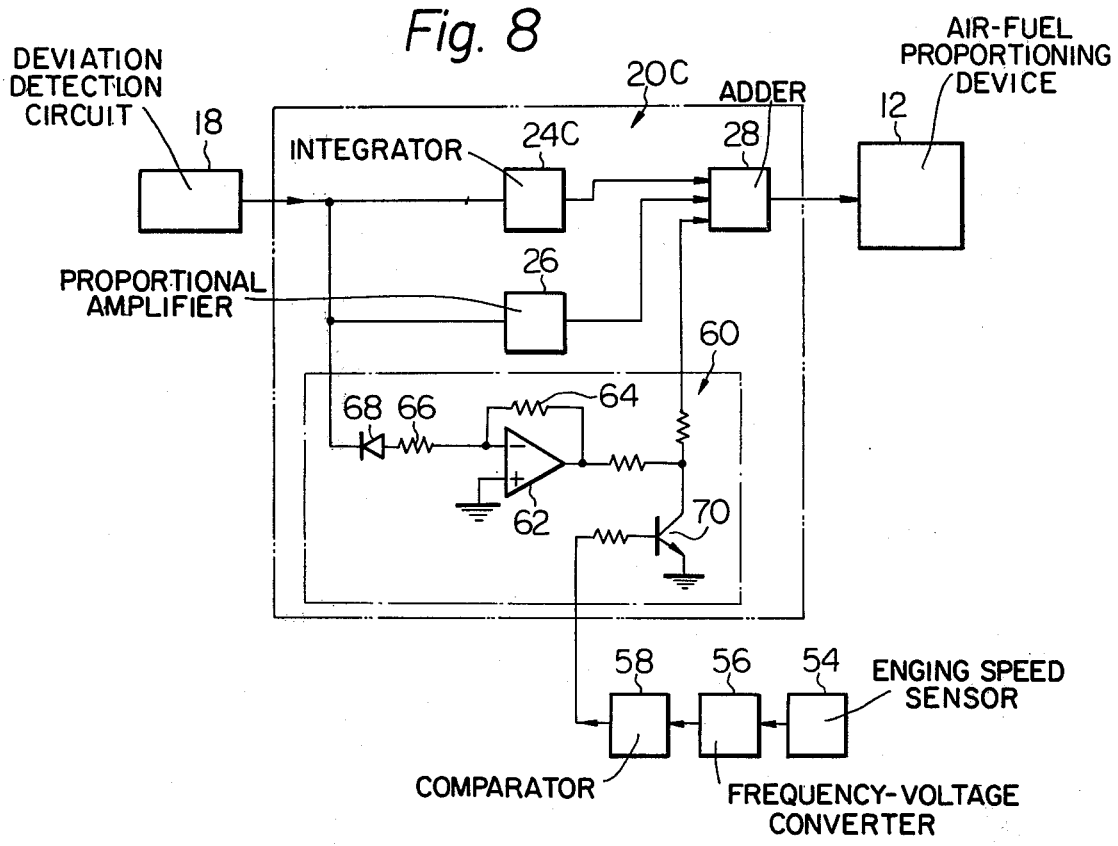
FIG. 8 is a circuit diagram of a still differently constructed control circuit as a still another embodiment of the invention.

In FIG. 8, a control circuit 20C is constructed to accomplish the proportional amplification of a plus input and a minus input respectively by two different proportionality constants at low engine speeds. This control circuit 20C has an integrator 24C, the proportionater 26 and the adder 28 all constructed and arranged according to the prior art: neither the integrator 24C nor the proportionater 26 has the function of shifting the control middle. The control circuit 20C has another (second) proportionater 60 in parallel with the usual proportionater 26. The second proportionater 60 has an operational amplifier 62 provided with negative feedback through a resistor 64. An input line for applying the output of the deviation detection circuit 18 to the negative input terminal of the operational amplifier 62 has a resistor 66 and a diode 68 which is conductive when the input is minus. The output terminal of this proportionater 60 is grounded through a transistor 70, and the herinbefore described combination of the engine speed sensor 54, the converter 56 and the comparator 58 hold the transistor 70 non-conductive when the engine speed is below a predetermined speed.

Figure 9:
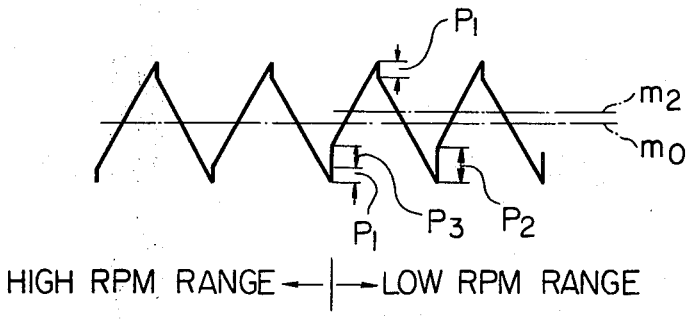
FIG. 9 is a chart showing the waveform of a control signal produced by the control circuit of FIG. 8.

The proportionater 60 makes no contribution to the production of the control signal while the engine speed is above the predetermined speed. Only when the engine speed is below the predetermined speed and a minus input is given to the control circuit 20C, an output is supplied from the proportionater 60 to the adder 28 and added to the outputs of the integrator 24C and the proportionater 26. Consequently, the output of the control circuit 24C takes a waveform as shown on the right side of FIG. 9 at low engine speeds. (The plus and minus signals alternately provided by the comparator 18 are assumed to be of the same and constant amplitude in both FIG. 6 and FIG. 9.) When the input is a plus signal at low engine speeds, the magnitude of the proportional component of the control signal is as indicated at $P_1$ in FIG. 9. For a minus input, the proportional component has a magnitude $P_2$ which is larger than $P_1$ by the magnitude of the output of the second proportionater 60 indicated at $P_3$. At high engine speeds, the magnitude of the proportional component is independent of the sign of the input as seen on the left side of FIG. 9. In the control circuit 20C, the control middle remains constantly at the basic value $m_o$ so long as the engine speed is above the predetermined speed but shifts to a different value $m_2$ at lower engine speeds, meaning that the control aims at either the preset air-to-fuel ratio or a provisional ratio which is definite. It is possible, however, to modify this control circuit 20C so as to continuously vary the provisional air-to-fuel ratio according to a variation in the engine speed.

What is claimed is:

1. A control system for maintaining the air-to-fuel ratio of a combustible mixture fed to an internal combustion engine at a preset ratio, the system comprising:

an electrically controllable air-fuel proportioning device;

an oxygen sensor of the concentration cell type having a layer of a solid electrolyte installed in an exhaust line of the engine to produce an electrical first signal representing the concentration of oxygen in the exhaust gas as an indication of a realized air-to-fuel ratio, said first signal standing at a first voltage level while the realized air-to-fuel ratio is below a stoichiometric air-to-fuel ratio but at a second voltage level lower than said first voltage level while the realized air-to-fuel ratio is above the stoichiometric ratio, a time-voltage gradient of a transition of said first signal from one of said first and second voltage levels to the other varying in dependence on the temperature and flow velocity of the exhaust gas at a section of the exhaust line where said oxygen sensor is installed, said gradient becoming less steep as at least one of the temperature and flow velocity of the exhaust gas lowers particularly when the transition proceeds from said first voltage level to said second voltage level;

a deviation detection circuit for producing a second signal representing a deviation of said first signal from a reference signal; and a control circuit for producing a control signal to control the function of said air-fuel proportioning device based on said second signal, said control circuit including:

a compensation means for varying the relation between said second signal and said control signal while at least one of the temperature and flow velocity of the exhaust gas is each below a predetermined level in such a manner that an air-to-fuel ratio implied by said control signal as a superficial target of the air-to-fuel ratio control is shifted from said preset ratio to a provisional ratio which is below said preset ratio, the difference between said preset ratio and said provisional ratio being determined so as to compensate for less steepening of said time-voltage gradient; and an integrator for producing said control signal based on an integration of said second signal, said compensation means accomplishing the superficial shift of the aim of the control by varying the time constant for the integration.

2. A control circuit as claimed in claim 1, wherein said time constant is continuously varied in dependence on the engine speed.

3. A control system as claimed in claim 2, wherein said integrator comprises an operational amplifier, a capacitor through which negative feedback is afforded to said operational amplifier, a first resistor through which said deviation detection circuit is connected to the negative input terminal of said operational amplifier, a second resistor connected in parallel with said first resistor, and a diode which is connected in parallel with said first resistor to interpose between said deviation detection circuit and said second resistor and becomes conductive only when said second signal is at a level in a predetermined range.

4. A control system as claimed in claim 1, wherein said time constant is varied only when the engine speed is below a predetermined speed.

5. A control system as claimed in claim 4, wherein said integrator comprises an operational amplifier, a capacitor through which negative feedback is afforded to said operational amplifier, a first resistor connected to the negative input terminal of said operational amplifier, a first diode which is interposed between said deviation detection circuit and said first resistor and becomes conductive only when said second signal is at a level below a predetermined level, a second resistor connected in parallel with both said first resistor and said first diode, a second diode which is connected in parallel with said first diode and in series with said second resistor and becomes conductive only when said second signal is at a level above said predetermined level, third and fourth resistors connected in series with each other and with said second diode but in parallel with said second resistor, and a switching means for grounding the junction point between said third and fourth resistors when the engine speed is below said predetermined speed.

6. A control system as claimed in claim 5, wherein said second resistor has a larger resistance than said first resistor.

7. A control system as claimed in claim 6, wherein a combined resistance composed by said second, third and fourth resistors is approximately equal to the resistance of said first resistor.

8. A control system as claimed in claim 5, wherein said switching means include a transistor connected to said third and fourth resistors to ground the junction point between them when said transistor is conductive, a sensor for producing a pulse signal with a variable frequency representing the engine speed, a converter for converting said pulse signal to a continuous voltage signal and a comparator for supplying a voltage to the base of said transistor when the amplitude of said continuous voltage signal is below a predetermined voltage.

9. A control system for maintaining the air-to-fuel ratio of a combustible mixture fed to an internal combustion engine at a preset ratio, the system comprising:

an electrically controllable air-fuel proportioning device;

an oxygen sensor of the concentration cell type having a layer of a solid electrolyte installed in an exhaust line of the engine to produce an electrical first signal representing the concentration of oxygen in the exhaust gas as an indication of a realized air-to-fuel ratio, said first signal standing at a first voltage level while the realized air-to-fuel ratio is below a stoichiometric air-to-fuel ratio but at a second voltage level lower than said first voltage level while the realized air-to-fuel ratio is above the stoichiometric ratio, a time-voltage gradient of a transition of said first signal from one of said first and second voltage levels to the other varying in dependence on the temperature and flow velocity of the exhaust gas at a section of the exhaust line where said oxygen sensor is installed, said gradient becoming less steep as at least one of the temperature and flow velocity of the exhaust gas lowers particularly when the transition proceeds from said first voltage level to said second voltage level;

a deviation detection circuit for producing a second signal representing a deviation of said first signal from a reference signal; and a control circuit for producing a control signal to control the function of said air-fuel proportioning device based on said second signal, said control circuit including:

a compensation means for varying the relation between said second signal and said control signal while at least one of the temperature and flow velocity of the exhaust gas is each below a predetermined level in such a manner that an air-to-fuel ratio implied by said control signal as a superficial target of the air-to-fuel ratio control is shifted from said preset ratio to a provisional ratio which is below said preset ratio, the difference between said preset ratio and said provisional ratio being determined so as to compensate for less steepening of said time-voltage gradient; and a proportional amplifier for producing said control signal based on a proportional amplification of said second signal, said compensation means accomplishing the superficial shift of the aim of the control by varying the proportionality constant for the amplification depending on the level of said second signal when the engine speed is below a predetermined speed, said proportional amplifier comprising:

an operational amplifier, a first resistor through which negative feedback is afforded to said operational amplifier, a second resistor connected to the negative input terminal of said operational amplifier, a diode which is interposed in series between said deviation detection circuit and said second resistor and becomes conductive when said second signal is at a level below a predetermined level, and a switching means for grounding the output terminal of said operational amplifier when the engine speed is above said predetermined speed, said control circuit further comprising another proportional amplifier for accomplishing a proportional amplification of said second signal by a definite proportionality constant and an adder for adding the output of said another proportional amplifier to the output of the firstly recited proportional amplifier.

10. A control system as claimed in claim 9, wherein said switching means include a transistor connected to the output terminal of the firstly recited operational amplifier, a sensor for producing a pulse signal with a variable frequency representing the engine speed, a converter for converting said pulse signal to a continuous voltage signal and a comparator for supplying a voltage to the base of said transistor when the amplitude of said continuous voltage signal is above a predetermined voltage.

* * * * *